US006190018B1

(12) United States Patent
Parsons et al.

(10) Patent No.: US 6,190,018 B1
(45) Date of Patent: Feb. 20, 2001

(54) MINIATURE LED FLASHLIGHT

(75) Inventors: Kevin L. Parsons, Appleton, WI (US); Donald A. Keller, Irving; W. Clay Reeves, Dallas, both of TX (US)

(73) Assignee: Armament Systems and Procedures, Inc., Appleton, WI (US)

( * ) Notice: Under 35 U.S.C. 154(b), the term of this patent shall be extended for 0 days.

(21) Appl. No.: 09/226,322

(22) Filed: Jan. 6, 1999

(51) Int. Cl.[7] ..... F21V 33/00
(52) U.S. Cl. ..... 362/116; 362/200; 362/800
(58) Field of Search ..... 362/116, 196, 362/200, 800, 205

(56) References Cited

U.S. PATENT DOCUMENTS 2,465,114 * 3/1949 Oury ..... 362/196
5,122,943 * 6/1992 Pugh ..... 362/286
5,143,442 * 9/1992 Ishikawa et al. ..... 362/253
5,730,013 * 3/1998 Huang ..... 70/395
5,934,789 * 8/1999 Sinclair et al. ..... 362/189
6,006,562 * 12/1999 Wolter ..... 70/456
6,039,454 * 3/2000 Hallfrimsson ..... 362/116

OTHER PUBLICATIONS

Photographs of Master Lock Backpack/Luggage Lock.
Photon Micro–Light.

* cited by examiner

*Primary Examiner*—Sandra O'Shea
*Assistant Examiner*—John Anthony Ward
(74) *Attorney, Agent, or Firm*—McDonnell Boehnen Hulbert & Berghoff

(57) ABSTRACT

A flashlight having a power source and a light source having a high intensity positioned in a power source frame. The flashlight further includes a power source frame housing that encloses the power source frame. The frame and the housing cooperate to secure and protect the internal components of the flashlight. The flashlight is further provided with side covers that have flat surfaces to receive markings or engravings. A switch is provided to activate the light source, the switch preferably providing tactile feedback to the user.

26 Claims, 5 Drawing Sheets

MINIATURE LED FLASHLIGHT

BACKGROUND OF INVENTION

1. Field of Invention

This invention is directed generally to flashlights, and more particularly to a miniature flashlight using a light emitting diode ("LED") as a light source that is useful for law enforcement personnel and civilians alike.

2. Background of the Invention

Conventional general-purpose flashlights are well known in the prior art and have often been used by law enforcement personnel in the execution of their duties and in emergency situations. Flashlights are used for a wide variety of purposes. For example, they are often used during traffic stops to illuminate the interior of a stopped vehicle or to complete a police report in the dark. They are also used to facilitate searches of poorly lit areas and may be used to illuminate dark alleys or stairwells. Law enforcement personnel also use flashlights to check or adjust their equipment when positioned in a darkened area or at night time, and also use flashlights to send coded signals to one another. Consequently, it is common, and frequently required, for law enforcement personnel to carry a flashlight, as well as other law enforcement equipment such as a sidearm, handcuffs, and an expandable baton. With such a large number of items, often it is difficult and cumbersome for law enforcement personnel to carry all of these items on their person.

Generally, conventional flashlights include an incandescent lightbulb and conventional drycell batteries enclosed in a housing typically constructed of a body section and a head section. Flashlights of this type are often bulky and cumbersome. Sometimes law enforcement personnel use a holster to enable them to carry a flashlight on their person. However, the size and weight of conventional flashlights add to the inconvenience and reduce the mobility of law enforcement personnel required to carry such flashlights along with the other law enforcement equipment. Sometimes the flashlight is purposefully or inadvertently left behind. This presents a problem when the need for a flashlight arises and the flashlight is not located on the person, or otherwise readily available In addition to the use of flashlights by law enforcement personnel, civilians also use flashlights for a number of different reasons. Besides the traditional, home uses of flashlights, smaller flashlights are used in today's society for various security purposes. For example, when going to one's car late in the evening, it is not uncommon for an individual, especially a female, to carry a small flashlight with her. She can use the flashlight to assist in getting the key in the keyhole in the dark. Additionally, she can use the flashlight to check whether someone is hiding in the back seat before getting into the car. Even small conventional flashlights, however, are cumbersome and inconvenient to carry for this purpose.

Thus, there is a need for a compact, lightweight flashlight that may easily be carried on the person of a law enforcement officer or civilian. Even the smallest of conventional flashlights are too bulky and cumbersome to be conveniently attached to one's keychain or carried on one's clothing. Thus, there is a further need for a flashlight that may be easily attached to, and carried on, one's clothing or keychain to help insure that the flashlight remains in possession of the user and can be quickly and easily retrieved when needed.

3. Description of the Prior Art

Although not having been proven useful to law enforcement personnel, there exists in the prior art a small flashlight known as the Photon Micro Light. The Micro Light consists of two flat, circular 3-volt batteries, a light emitting diode ("LED") and an outer shell that encloses the batteries and leads of the LED. The Micro Light uses a slide switch or pressure switch that activates the light by moving the leads of the LED into direct engagement with the batteries. The outer shell consists of two hard plastic parts opposite either side of the batteries and may be held together with four threaded screws.

The Micro Light, however, has a number of disadvantages. The Micro Light lacks the durability required for a miniature flashlight. It lacks an internal structure for protecting and securing the batteries and LED. Only the hard plastic outer shell protects the internal components of the flashlight. Thus, little protection is provided for the internal components of the flashlight and the Micro Light may be adversely affected when subjected to shock. Further, since threaded screws are required to assemble the outer shell parts of the flashlight together, their use increases the time required to assemble the flashlight. In addition, the Micro Light has a very small keyring hole that is not well adapted for securing the flashlight to a keychain, or to otherwise readily attach to or disattach from one's clothing.

The Micro Light operates by using either a slide switch or pressure switch which upon activation brings both the leads of the LED into direct engagement with the batteries. This results in increased fatigue on the leads of the flashlight and undesirable wear that affects the reliability of the switch. Moreover, because of its external shape and hard plastic outer shell construction, the Micro Light is not suitable for receiving markings or engravings on the outside surfaces thereof. In many instances it is desirable to color code the exterior of the flashlight, or to provide engravings, markings, or other indicia on the exterior surface. However, the construction of the Micro Light is not well suited or adapted to allow for any such color coding or desired markings or engravings.

SUMMARY OF THE INVENTION

The subject invention is specifically directed to a small, compact flashlight useful to both law enforcement personnel and civilians. The invention includes a power source, a light source, which is preferably a high intensity LED, and a non-conductive power source frame having a cavity adapted to house the power source. The power source frame may also have a receptacle for receiving and housing a connector end of the light source. The power source frame therefore serves as a fitted compartment for holding in place and protecting the various internal components of the flashlight. The use of a power source frame provides significant protection to the power source and the light source and serves to cushion these elements from the adverse affects of any shock the flashlight might receive. The invention further includes a power source frame housing that encases the power source frame, and provides further protection to the internal components of the flashlight, in addition to that provided by the power source frame. The power source frame housing thus serves to provide an additional level of protection to the light source and the power source and enhances the durability of the flashlight. The invention further includes a switch for completing a circuit to energize the light source.

As mentioned above, the light source is preferably an LED that has a high luminous intensity. Manufacturers of LEDs grade the LED according to its quality. The highest quality LEDs are given an "E" grade. The next highest quality is a "D" grade. LEDs with a "D" grade can be equipped with a lens to approximate the quality of an "E" grade LED. LEDs of this quality were initially used in medical applications and are sometimes referred to as having medical grade application. Although the flashlight of the present invention can be used with any conventional LED, in a preferred embodiment, the light source is an "E" grade LED or lensed "D" grade LED. Such a high intensity LED may be obtained from Hiyoshi Electric, Co., Ltd. located in Tokyo, Japan, having Part No. E1L53-3BL. The high intensity LED herein described has from three to five times the luminous intensity of a conventional LED. The LED preferably emits blue light, although the present invention may be used with any color LED. Blue light helps to preserve a user's night vision compared with conventional flashlights emitting white light. For other applications blue-green LEDs can be used, for example, in situations where compatibility with night vision equipment is desired. Other colored LEDs can also be used. Red LEDs can be used in applications where the preservation of night vision is desired or for use with pilots and photographers, and even infrared LEDs can be used where certain signaling capabilities are required or for use with equipment that senses infrared light. The LED includes first and second leads extending from a connector end of the LED. The leads may be provided with extensions that can be soldered onto the leads of the LED.

The power source of the invention may be any battery having sufficient power to energize an LED. The power source is preferably round and has oppositely disposed generally flat sides, sometimes referred to as coin cells. A pair of stacked 3-volt batteries of this type may be used as the power source. Three-volt lithium batteries are preferably used to provide for longer life, and greater shelf life.

The power source frame of the invention may be made of non-conductive plastic and preferably has generally flat oppositely disposed first and second sides. The power source frame may be adapted to receive and house a power source, and includes a power source cavity for this purpose. The power source frame also includes a receptacle at a front end to receive and house a connector end of an LED. The leads of the LED are preferably positioned so that one lead extends over the first side of the power source and another lead extends over the second side of the power source. The power source frame protects and secures the internal components of the flashlight. The power source frame also provides resistance to shock and safeguards the light source and power source within its frame.

A switch element is preferably located on the side opposite of the power source cavity. The side of the power frame opposite the side having the power source cavity includes a counterbore having a terminus in the power source frame that houses a switch element. The switch element is preferably a dome plate that is located between one of the leads of the LED and the power source, but out of contact with the power source. The dome plate is sometimes referred to as a tactile dome plate or a snap dome plate. The switch is activated by applying pressure to the dome plate, thereby completing a circuit that includes the leads of the LED and the power source. With this switch arrangement, a switch button is depressed forcing one lead of the LED into contact with the dome plate which in turn contacts the power source. Thus, in this embodiment, one lead of the LED never comes into direct contact with the power source. Once pressure is removed from the button, the contact between the dome plate and power source is broken and the flashlight returns to its normal "off" position. Thus, the switching arrangement reduces the wear on the leads of the LED and increases the overall reliability.

In one embodiment of the invention, the power source frame is adapted to receive a weight, which is preferably round and has opposite ends coplanar with the opposite sides of the power source frame. The weight may be press fit into a cavity or tapered hole in the power source frame specifically adapted to receive the weight. The weight provides for a heavier flashlight and improved balance. In addition, the weight provides the flashlight with greater substance and as a result a higher perceived value in the hands of the user. With the additional weight added to the flashlight, the flashlight appears more substantial and of a higher quality than a lighter weight flashlight.

The flashlight of the invention also includes a power source frame housing that encases the power source frame, the power source, and the leads of the LED. The power source frame housing is preferably of a two piece construction, with each piece disposed on either side of the power source frame. The power source frame housing includes a first housing side disposed about the first side of the power source frame and a second housing side disposed about the second side of the power source frame, the two sides conforming to the periphery of the power source frame.

The power source frame may have a plurality of pegholes located about the periphery of either side thereof. In addition, the first and second housing sides of the power source frame housing are provided with a plurality of pegs extending from an inner periphery thereof. The pegs are positioned to engage in a mating relationship with the plurality of pegholes located about the periphery of the sides of the power source frame such that the housing sides can be engaged with the power source frame. The mating of the pegs and the pegholes facilitates assembly of the flashlight by allowing the parts to be precisely aligned during their assembly. It has been found that gluing the power source frame housing to the power source frame provides for a suitable adhesion of the parts. Alternately, ultrasonic welding can be used to attach the parts. Unlike the prior art, separate screws are not needed to attach the parts of the flashlight together and thus assembly is facilitated.

The flashlight of the invention may also be provided with first and second side covers that are positioned between the first and second housing sides of the power source frame housing and the power source frame. The side covers preferably lie in parallel planes and may have flat outer surfaces that are capable of receiving engravings or markings. It is often desirable to engrave or imprint the side covers with surface indicia. For example, a company logo or name of a product could be located on either of the side covers. The use of engraving or printing on the side covers can be used for promotional or advertising purposes. In addition, a flashlight bearing certain markings on the side covers could serve as a prize or be used to commemorate an important event. In one embodiment, a die struck medallion could be inset in the side cover.

The side covers can be made of a variety of materials, such as metal, plastic, or other protective materials. The side covers are preferably made of aluminum. Aluminum provides the desired strength to the side covers and is easily engraved or imprinted. Indicia may be laser engraved, silk screened, inked, pad printed, or marked in any known manner.

The side covers are sandwiched between the either side of the power source frame by the power source frame housing. The side covers provide additional protection to the internal components of the flashlight. The sturdy aluminum construction serves to guard the light source and power source from external forces. Moreover, there is an insulated pocket located between the power source frame and the side covers that provides an air cushion that serves to further protect the light source and power source within the power source frame housing. The side covers are manufactured as separate components of the flashlight from the power source frame housing. Thus, side covers of varying colors may used to assemble flashlights of varying and contrasting colors. For example, flashlights having side covers bearing corporate colors can be easily assembled. Similarly, flashlights having side covers bearing the colors of a favorite team can be provided. For example, a flashlight having a green side cover on one side and a yellow side cover on the other side could be used to represent the colors of the Green Bay Packers. In addition, a Green Bay Packers logo could be included on one or both side covers of the flashlight.

One of the side covers may be adapted to receive a switch button that may be secured to the side cover. The button may be made of rubber, and is preferably made of Kraton, the trade name of a thermoplastic rubber made by the Shell Oil Company, and located adjacent the power source. When the button is pushed, a circuit including the leads of the LED and the power source is completed.

The power source frame housing may be provided with a keyring extension. Alternatively, the keyring extension may be attached to, or integral with, the power source frame. The keyring extension includes a keyring lock such that when a force is exerted against the keyring lock, the keyring extension is opened to permit a keyring to be attached to the keyring extension. The keyring lock is preferably spring-biased and may be attached to the power source frame. The keyring lock pivots about a circular post positioned on the power source frame. The keyring extension may be easily attached and detached from any number of items, such as the zipper of a coat or backpack, the handle of a purse or briefcase, a beltloop, or any other handle or case.

The flashlight of the present invention is small, compact and easy to operate. The flashlight may easily be carried in the pocket, on the clothing, or on the keychain of law enforcement personnel or civilians. The flashlight may also be quickly and easily retrieved and operated.

It is, therefore, an object and feature of the subject invention to provide a flashlight that is exceptionally durable and reliable having a light source, preferably a high-intensity LED, a power source, a power source frame, and a power source frame housing encasing the power source frame, and a switch to activate the LED.

BRIEF DESCRIPTION OF THE DRAWINGS

Further advantages of the present invention will become apparent to those skilled in the art with the benefit of the following detailed description of the preferred embodiments and upon reference to the accompanying drawings in which.

Figure 1:
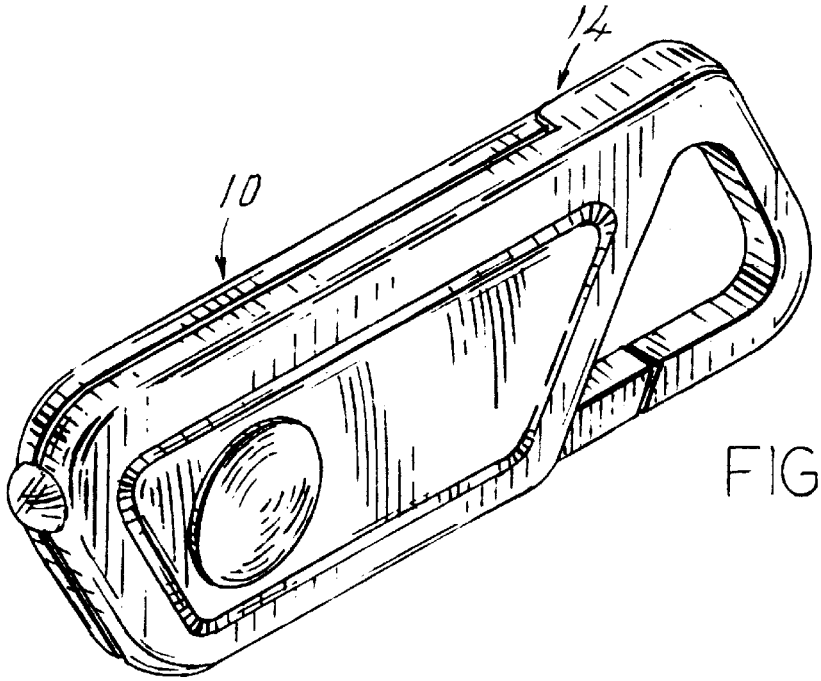
FIG. 1 is a perspective view of an embodiment of the flashlight of the present invention.

While the invention is susceptible to various modifications and alternative forms, specific embodiments thereof are shown by way of example in the drawings and will herein be described in detail. It should be understood, however, that the drawings and detailed description thereof are not intended to limit the invention to the particular form disclosed, but on the contrary, the invention is to cover all modifications, equivalents and alternatives falling within the spirit and scope of the present invention.

DETAILED DESCRIPTION OF THE PREFERRED EMBODIMENT

A handheld flashlight 10 made in accordance with the principles of the subject invention is depicted in FIGS. 1–18. As shown in FIG. 2, flashlight 10 preferably includes a side cover 12, a power source frame housing 14, a keyring extension 16, a keyring lock 80, a switch button 18, and a light source 20, extending from a front end of the flashlight.

Figure 3:
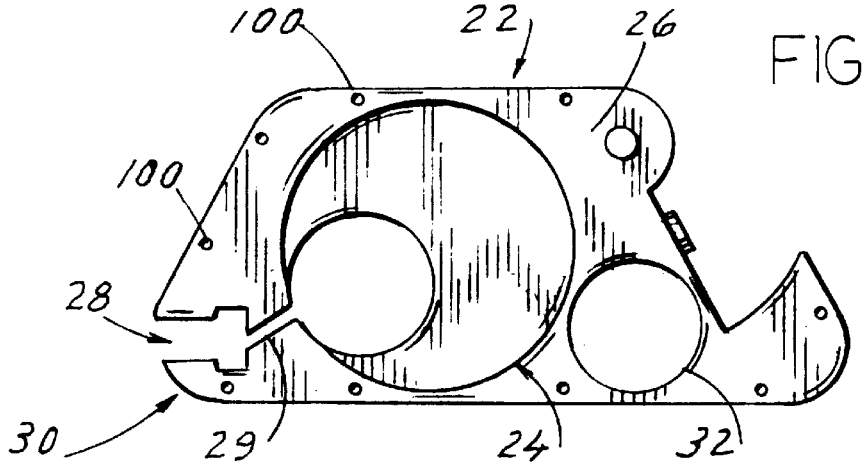
FIG. 3 is a side view of a first side of the power source frame.
Figure 4:
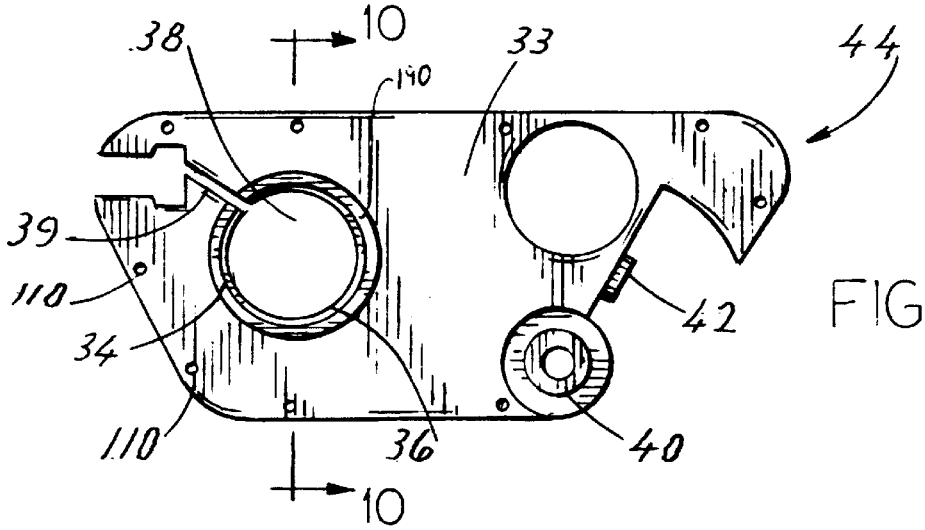
FIG. 4 is a side view of a second side of the power source frame opposite the first side.

As depicted in FIGS. 3 and 4, the flashlight of the subject invention further includes a power source frame 22. The power source frame 22 has oppositely disposed first and second sides 26, 33 that are generally flat and lie in parallel planes. The power source frame 22 further includes a cavity 24 located on the first side 26 of the power source frame adapted to receive a power source, such as that depicted in FIG. 5. The frame 22 also is provided with a receptacle 28 at a front end 30 thereof, adapted to receive a light source, such as that depicted in FIG. 6. The first side 26 further includes a light source lead channel 29 extending from receptacle 28 to cavity 24 to allow a lead from the light source 20 to extend over cavity 24.

As depicted in FIG. 3, the power source frame 22 may also include an area 32 adapted to receive a weight. In the embodiment shown in the figures, although not required, the area 32 is a throughhole extending from the first side 22 of the frame to the second side 33 of the frame. Area 32 is tapered at a slight angle to allow the weight to be friction fit within area 32.

The power source frame 22 is further provided with a plurality of pegholes 100 positioned about an outer periphery of the first side 26 of the power source frame. The pegholes 100 are adapted to receive a corresponding set of pegs located on the power source frame housing 14. The mating of the pegs with the pegholes positions the power source frame housing 14 in proper alignment with the power source frame 22. The power source frame housing may be ultrasonically welded to the power source frame and/or glued thereto. Thus, there is no need to use threaded screws or other fastening means to hold the frame and the housing together. As a result, the flashlight of the invention is assembled without difficulty.

The power source frame 22 is preferably made of a non-conductive material. Preferably, the power source frame 22 is comprised of Acrylonitrile Butadiene Styrene "ABS" which provides for exceptional durability and toughness. However, any non-conductive material may be employed to construct the frame 22.

FIG. 4 depicts a side view of the second side 33 of power source frame 22. The second side 33 is provided with a counterbore 34 having a terminus 36 within the power source frame 22. As shown in FIG. 4, the counterbore 34 is adapted to receive a switch element. The counterbore 34 is preferably located opposite the power source cavity 24 and includes a throughhole 38 extending into cavity 24 that is located on the first side 26 of the power source frame 22.

As with the first side 26, the second side 33 preferably includes a light source lead channel 39 extending from receptacle 28 to counterbore 34 to allow a lead from the light source 20 to extend over counterbore 34. The second side 33 of power source frame 22 may preferably further include a post 40 about which an element of the keyring lock 80 may pivot. Power source frame 22 is also provided with a hub 42 located on a rear side 44 of the frame 20 that is adapted to secure one end of a spring element associated with the keyring lock 80. As with the first side, the second side 33 of the power source frame may be provided with a plurality of pegholes 110 positioned about its outer periphery to mate with a corresponding set of pegs located on the power source frame housing 14.

Figure 5:
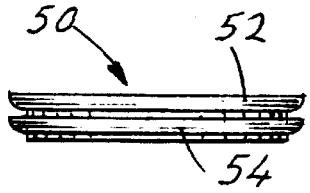
FIG. 5 is a side view of a power source consisting of two circular batteries having generally flat sides.

The power source may be any type of battery with sufficient power to energize the light source. As shown in FIG. 5, the power source is preferably one or more circular batteries 50 having generally flat oppositely disposed first and second sides 52 and 54. In a preferred embodiment, the power source consists of two 3-volt lithium coin cell batteries available from Panasonic bearing the CR2016 marking. These lithium batteries provide for exceptionally long life and durability. In addition, they operate at a low temperature, are leakproof, and vibration resistant.

Figure 6:
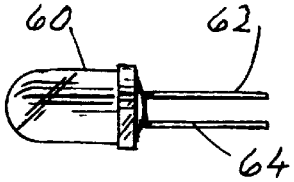
FIG. 6 is a side view of a light emitting diode (LED).
Figure 7:
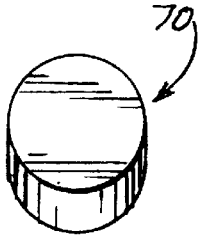
FIG. 7 is a perspective view of a weight.

The light source may be of any type suitable for flashlight use. As shown in FIG. 6, the light source is preferably a light emitting diode ("LED") 60 having first and second leads 62 and 64 extending therefrom. An LED provides great advantages over conventional neon or incandescent light sources, since it requires much less energy, is smaller in size, and more resistant to shock than conventional light sources. It also generates less heat and is more durable than a conventional light source. LEDs are widely available, inexpensive, and can be replaced easily and quickly. In a preferred embodiment, the light source is a high intensity LED having a high luminous intensity emitting blue light. The LED may be a "E" grade LED or a lensed "D" grade LED.

The flashlight may include a weight 70 positioned in area 32 on the power frame housing 14. The weight provides for a heavier flashlight and for improved balance. It also provides a more substantial feel to the flashlight resulting in a higher perceived value. In a preferred embodiment shown in FIG. 7, the weight 70 has a cylindrical shape and has oppositely disposed first and second faces that are generally flat and lie in parallel planes. The weight 70 preferably has a thickness equal to the thickness of the power source frame 14. It is preferably made of a dense metal material, preferably stainless steel, and preferably weighs approximately eleven grams. The weight is friction fit or press fit into the corresponding portion of the power source frame housing.

Figure 8:
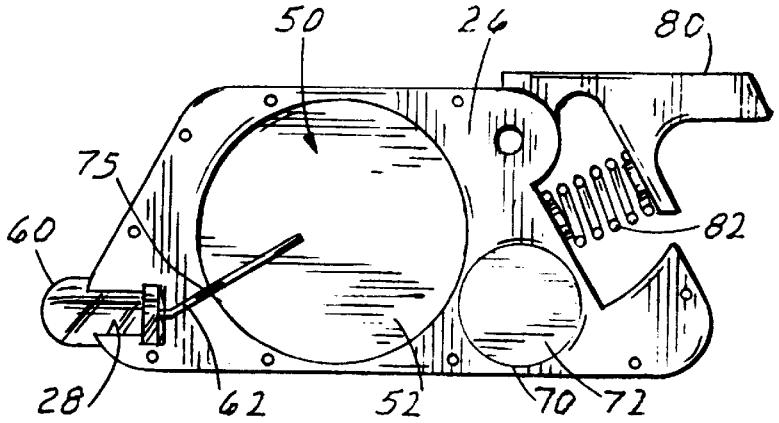
FIG. 8 is a side view of a first side of the power source frame including a power source, an LED, a keyring lock, and a spring.

FIG. 8 is a side view of the first side 26 of the power source frame 22 and depicts power source 50, LED 60, keyring lock 80, and spring 82. The power source frame 22 preferably has a thickness in the range of approximately 0.15 and 0.25 inch, and preferably 0.18 inches, which is approximately equal to the diameter of LED 60. As shown in FIG. 8, the LED 60 is positioned in receptacle 28 of the power source frame 22, and the power source 50 is positioned in the cavity 24 of the power source frame 22.

A first lead 62 of the LED 60 preferably extends over the first side 52 of the power source 50, which is preferably coplanar with the first side 26 of the power source frame 22. A lead extension 75 may be attached to the first lead 62 of the LED to extend the length of the lead. The lead extension 75 may be soldered to the first lead 62. The weight 70 may be positioned within the power source frame 22, and preferably has a first side 72 that is coplanar with the first side 26 of the power source frame. The weight 70 is preferably press fit or friction fit within the power source frame 22.

Figure 9:
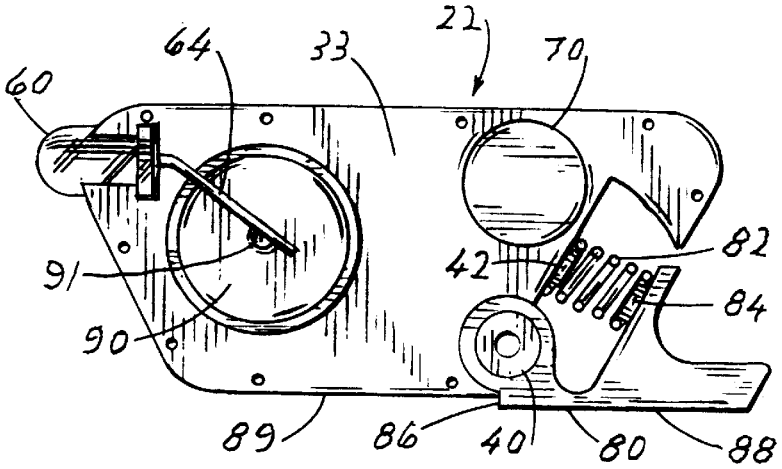
FIG. 9 is a side view of a second side of the power source frame including an LED, a weight, a keyring lock, a spring, and a switch element.

FIG. 9 is a side view of the second side 33 of the power source frame 22 and depicts LED 60, weight 70, keyring lock 80, spring 82 and switch element 90. As shown in FIG. 9, the switch element 90 is positioned in the counterbore 34. The switch element 90 has an outer periphery that contacts the terminus 36 of the counterbore 34, but is out of contact with the power source 50. The second lead 64 of LED 60 preferably extends over the switch element 90. A lead extension may be attached to the second lead 64, as required.

The switch element 90 is preferably a dome plate 92 or a convex conductor that is positioned in the counterbore 34, but out of contact with the power source 50. The dome plate is preferably made of a thin, flexible conductive metal stamping. The lead 64 of the LED contacts the dome plate. To ensure contact, the lead may be taped to the dome plate using, for example, 1.5 millimeter thick tape manufactured by 3M. The dome plate preferably has an engaging element 91 located at the center of its inner surface.

When pressure is applied to the dome plate, the dome plate flexes from a convex to a concave configuration, thereby completing the circuit through the first and second leads of the LED, the engaging element of the dome plate, and the power source. When the pressure is removed, the dome plate returns to its convex position breaking contact with the power source and returning the flashlight to its normal "off" position. In this manner, the lead does not come into direct contact with the power source. It should be noted that a number of alternative push button switch arrangements could be used. For example, the power source frame could include a flexible tongue adjacent to the power source. A lead of the LED could be wrapped around the tongue such that depression of the tongue would bring the lead of the LED into contact with another switch element or into direct contact with the power source to complete the circuit. Alternatively, the lead of the LED could be connected to a flexible tongue having a split metal eyelet adjacent the power source, such that depression of the tongue would complete the circuit. In addition, a number of other mechanical or electrical switches could be utilized, such as slide switches and pressure switches.

As shown in FIG. 9, the keyring lock 80 includes hub 84 operatively connected to a coil spring 82 which is in turn operatively connected to hub 42 of power source frame 22. It should be understood that many types of springs can be used to bias the keyring lock including coil springs, leaf springs, and U-shaped or plastic springs to name a few. The coil spring may be a separate component, or may be made integral with the power source frame. Spring 82 exerts a force to bias keyring lock 80 to pivot outwardly and about post 40. The keyring lock 80 is preferably adapted to pivot about post 40 for only a limited distance. Keyring lock 80 further includes a stop 86 that abuts the power source frame 22 to limit the travel of the keyring lock 80. Preferably, the stop 86 prevents an outer edge 88 of the keyring lock to travel beyond the position where the edge 88 is parallel to an edge 89 of the power source frame. Other keyring locking mechanisms could be used having other forms of springs or resistance to bias the keyring lock. Alternately, the keyring lock could be externally or internally hinged.

The keyring extension 16 and keyring lock 80 of the present invention provide a user with significant versatility in attaching the flashlight to the user's person. For example, the keyring lock 80 may be moved to its open position to allow the flashlight to be easily attached to the zipper of a coat or backpack, the handle of a purse or briefcase, a beltloop, or any other handle or case. In addition, because the keyring lock 80 is normally biased into its closed position, the keyring extension and keyring lock 80 can serve as a clip to easily fasten the flashlight to a shirt pocket or directly to one's clothing. In this manner the shirt pocket or portion of clothing is pinched between an outer end 134 of keyring lock 80 and an outer end 132 of keyring extension 16. (See FIG. 2). The ability to easily clip the flashlight to one's clothing provides the user with great flexibility in carrying the flashlight on one's person.

Figure 10:
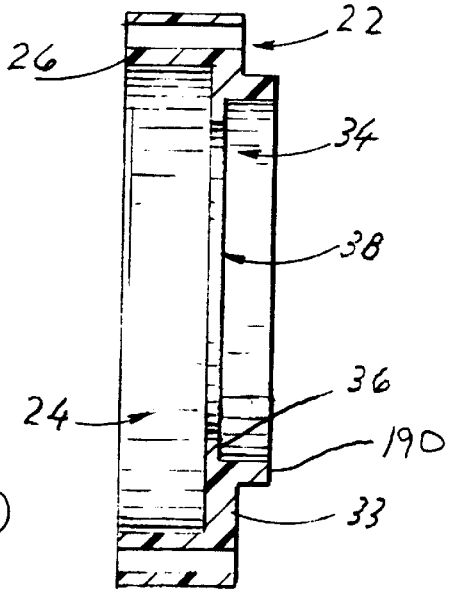
FIG. 10 is a cross-sectional view of the power source frame of FIG. 4 taken along plane 1—1.

FIG. 10 is a cross-sectional view of the power source frame 22 of FIG. 4 taken along line 1—1. Cavity 24 on side 26 preferably has a depth equal to the thickness of the power source 50 and encloses all but an outer surface of the power source. Counterbore 34 on side 33 is located opposite the cavity 24 and has a terminus 36 in the power source frame and throughhole 38 extending therethrough into cavity 24. The diameter of the counterbore 34 is preferably slightly larger than throughhole 38.

FIGS. 3–10 depict the inner workings of an embodiment of the present invention. However, the invention is not intended to be limited by the particular geometry, locations, and components depicted herein, which are illustrative.

Figure 2:
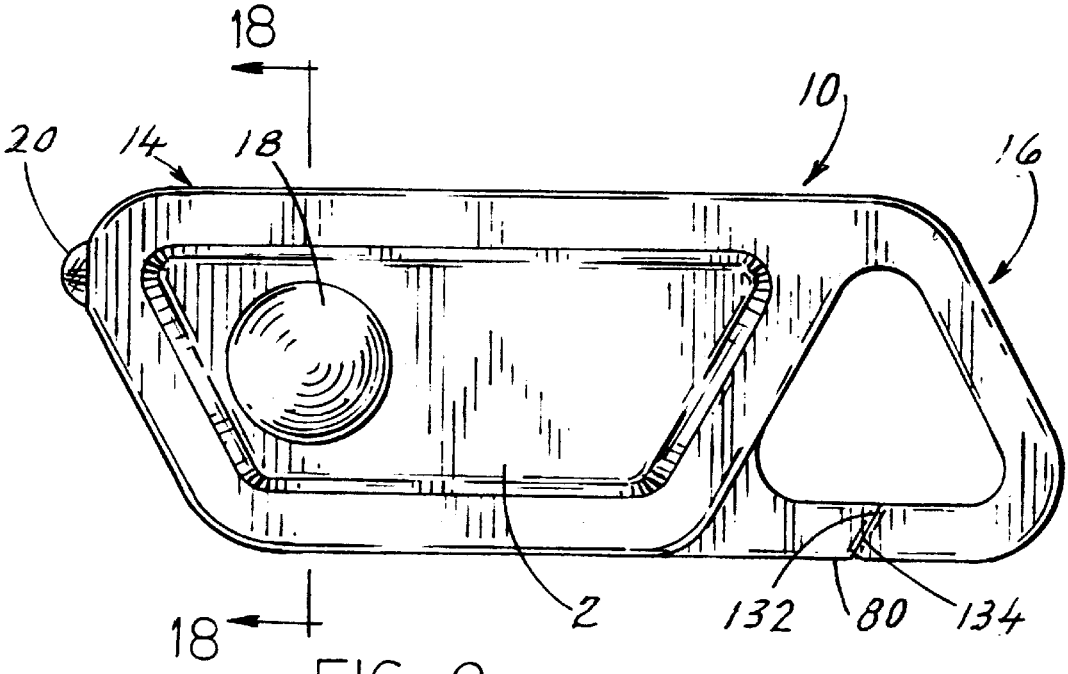
FIG. 2 is a side view of the flashlight depicted in FIG. 1.
Figure 11:
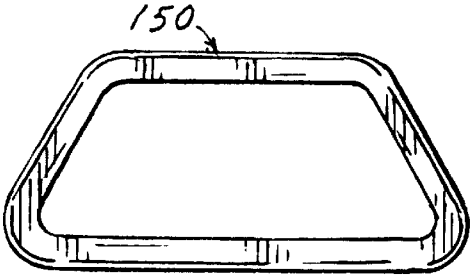
FIG. 11 is a side view of the exterior of a first side of the power source frame housing.

FIG. 11 is a side view of the exterior of a first housing side 150 of the power source frame housing 14 depicted in FIG. 1. First housing side 150 is adapted to fit over and enclose the first side 26 of the power source frame 22.

Figure 12:
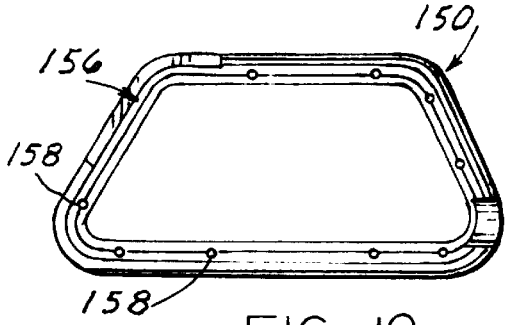
FIG. 12 is a side view of the interior of a first side of the power source frame housing.

FIG. 12 is a side view of the interior 156 of first housing side 150. A plurality of pegs 158 are preferably positioned about an inner periphery of the first housing side 150. As mentioned above, the pegs 158 are adapted to engage in a mating relationship a corresponding plurality of pegholes 100 located on an outer periphery of the first side 26 of the power source frame 22.

Figure 13:
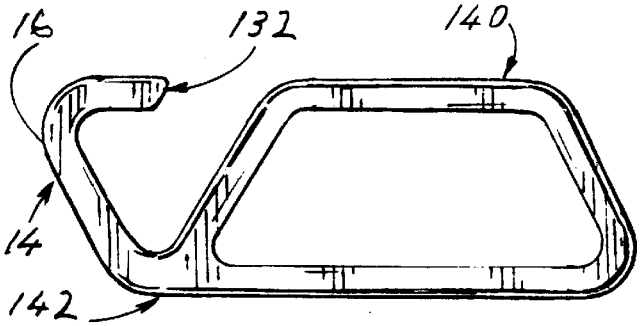
FIG. 13 is a side view of the exterior of a second side of the power source frame housing.

FIG. 13 is a side view of an exterior 142 of a second housing side 140 of power source frame housing 14 depicted in FIG. 2. The second housing side 140 is adapted to fit over and enclose the second side 33 of the power source frame 22. With reference to FIGS. 2 and 13, the exterior 142 includes a keyring extension 16 extending from a rear side 144 thereof. An outer end 132 of keyring extension 16 engages an outer end 134 of keyring lock 80 (as shown in FIG. 2). Alternatively, the keyring extension could be attached to, or integral with, the power source frame, such that the power source frame housing could fit over and enclose the power source frame, except for the keyring extension. In such an alternate embodiment, the second housing side 140 will be identical to the first housing side 150, shown in FIG. 12.

Figure 14:
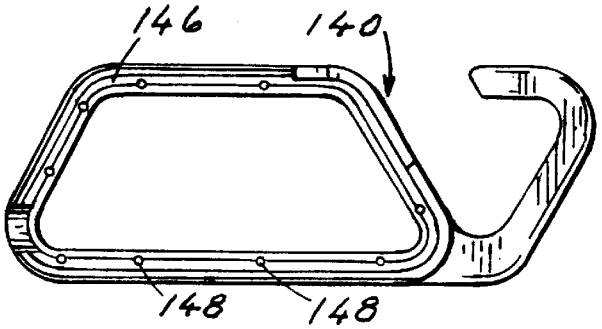
FIG. 14 is a side view of the interior of a second side of the power source frame housing.

FIG. 14 is a side view of an interior 146 of second housing side 140. A plurality of pegs 148 are preferably positioned about an inner periphery of second housing side 140. The pegs 148 are adapted to engage in a mating relationship a corresponding plurality of pegholes 110 located on an outer periphery of the second side 33 of the power source frame 22.

Figure 15:
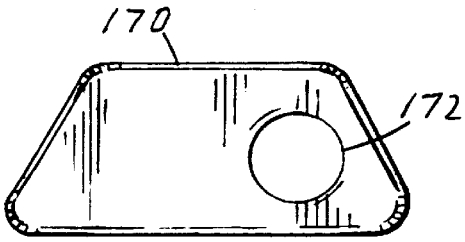
FIG. 15 is a side view of a first side cover.
Figure 16:
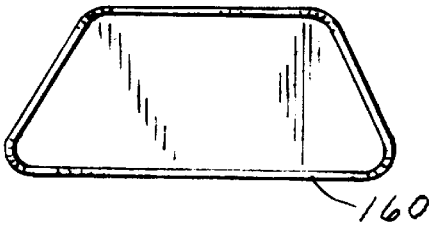
FIG. 16 is a side view of a second side cover.

FIGS. 11–14 show first and second power source frame housing sides having an opening therein to accommodate the side covers shown in FIGS. 15 and 16. It should be understood, however, that the power source frame housing sides are not limited to accommodating the particular side covers shown in FIGS. 15 and 16. They could be modified to be used with side covers of any geometry. In addition, the housing sides could be made without any openings and used without side covers, such that the power source frame housing sides would completely enclose the power source frame housing. Also, the power source frame housing can be made from any suitable material, and is preferably strong and durable. In a preferred embodiment, the power source frame housing is made of ABS.

FIGS. 15 and 16 are side views of first and second side covers 160 and 170. The first and second side covers are preferably positioned between the power source frame 22 and the power source frame housing 14. First and second side covers 160 and 170 are generally flat and adapted to conform to the outer surfaces of the power source frame 22 such that the side covers preferably lie in parallel planes when positioned between the power source frame 22 and the power source frame housing 14. The power source frame housing 14 conceals the edges of the side covers when they are positioned between the power source frame 22 and the power source frame housing 14. The side covers may be of any suitable material including metals, rubbers, and plastics. Preferably the side covers are made of stamped aluminum, preferably anodized 6061 aluminum, and have surfaces suitable for marking or engraving. As noted above, it is often desirable to engrave or imprint the side covers with surface indicia. For example, a company logo or name of a product could be located on either of the side covers. The use of engraving or printing on the side covers can be used for promotional or advertising purposes. In addition, a flashlight bearing certain markings on the side covers could serve as a prize or be used to commemorate an important event. In another embodiment, a die struck medallion could be inset in one of the side covers.

The side covers can be made of a variety of materials, such as metal, plastic, or other protective materials. The side covers are preferably made of aluminum. Aluminum provides the desired strength to the side covers and is easily engraved or imprinted. Indicia may be laser engraved, silk screened, inked, pad printed, or marked in any known manner.

The side covers are sandwiched between either side of the power source frame by the power source frame housing. The side covers provide additional protection to the internal components of the flashlight. The sturdy aluminum construction serves to guard the light source and power source from external forces. Moreover, there is an insulated pocket located between the power source frame and the side covers that provides an air cushion that serves to further protect the light source and power source within the power source frame housing. As noted above, in applications where no side covers are used, it is desirable to similarly provide a spaced pocket of air between the power source and the power source frame housing sides to further protect the light source and power source.

Figure 17:
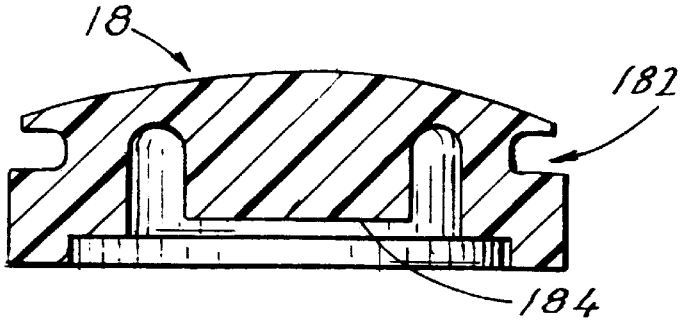
FIG. 17 is a cross-sectional view of a switch button.

As shown in FIG. 15, the second side cover 170 has a hole 172 therethrough adapted to receive a switch button 18 (shown in FIG. 17). When the side cover 170 is positioned between the power source frame 22 and the power source frame housing 14, hole 172 is located adjacent the switch element 90. In a preferred embodiment, a thin piece of foam (not shown) is attached to the inner surface of the first side cover 160. When the flashlight is assembled, the piece of foam serves to compress the first lead 62 of the light source 20 into engagement with power source 50. The piece of foam also serves to keep the elements of the power source frame 22 tightly enclosed therein, and prevents the internal components from rattling or making noise when in use.

FIG. 17 is a side view of switch button 18. Switch button 18 is preferably circular with a circular recess 182 about its periphery. The recess 182 is adapted to secure the switch button 18 to the second side cover 170. Switch button 18 is preferably made of a resilient material, such as rubber, to allow the button to deform when a force is exerted thereon. In a preferred embodiment, the switch button 18 is made of Kraton, the trade name of a thermoplastic rubber made by the Shell Oil Company.

The switch button 18 further includes an engaging element 184 on an interior surface thereof. When a force is exerted on the button, the engaging element 184 contacts the switch element 90 located in the power source frame 22. When not engaged, the engaging element 184 is preferably out of contact with the switch element 90.

Figure 18:
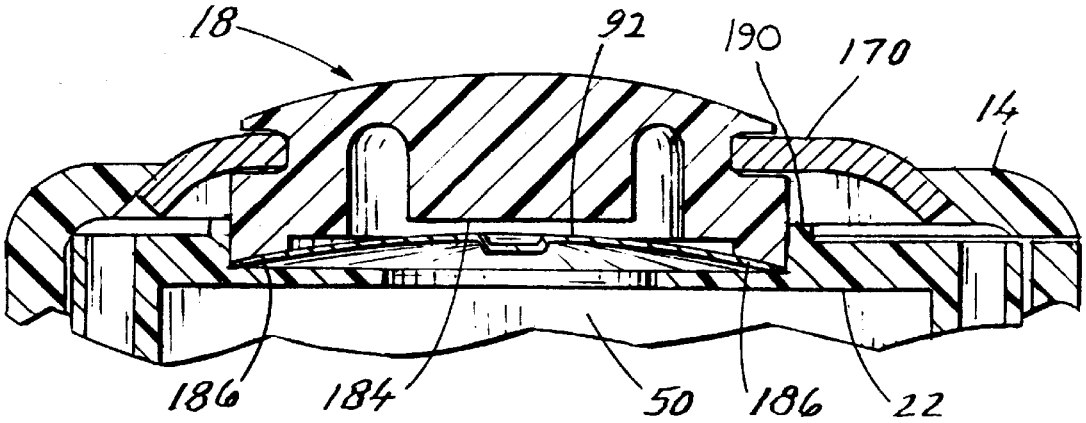
FIG. 18 is a partial cross-sectional view of the flashlight of FIG. 2 taken along the plane 2—2.
Figure 1:
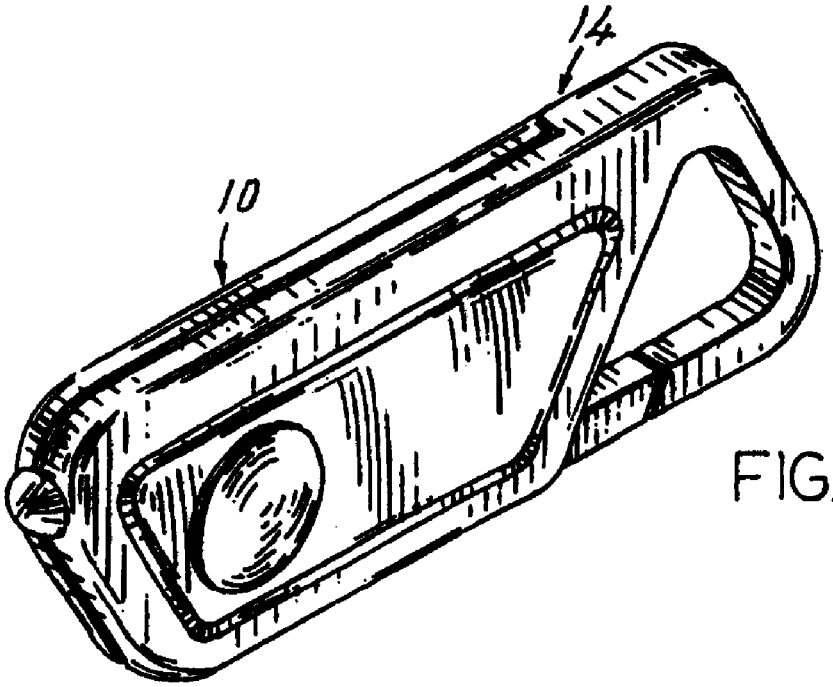
Figure 2:
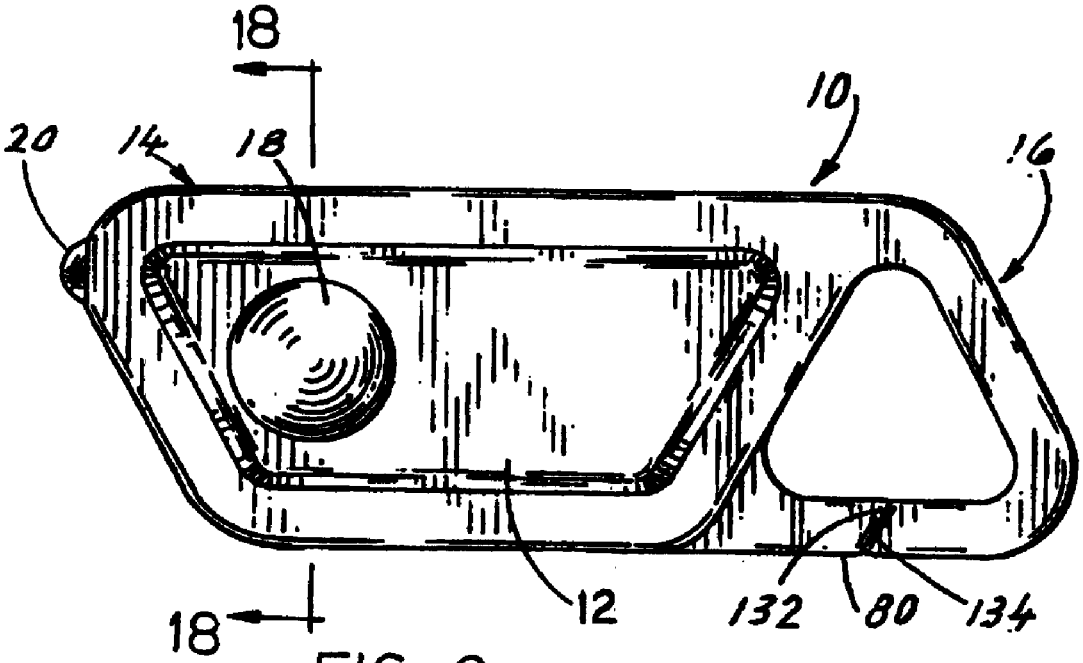
Figure 8:
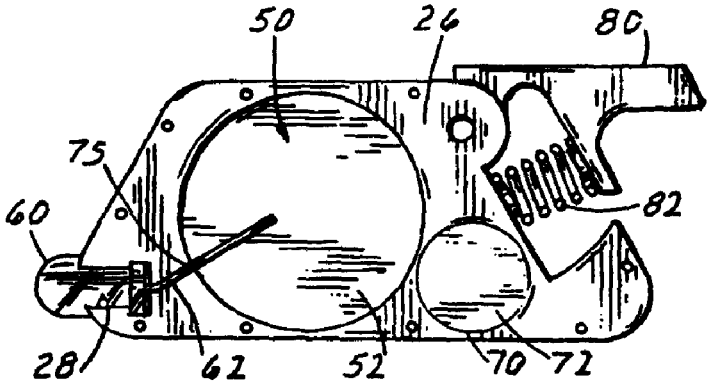
Figure 9:
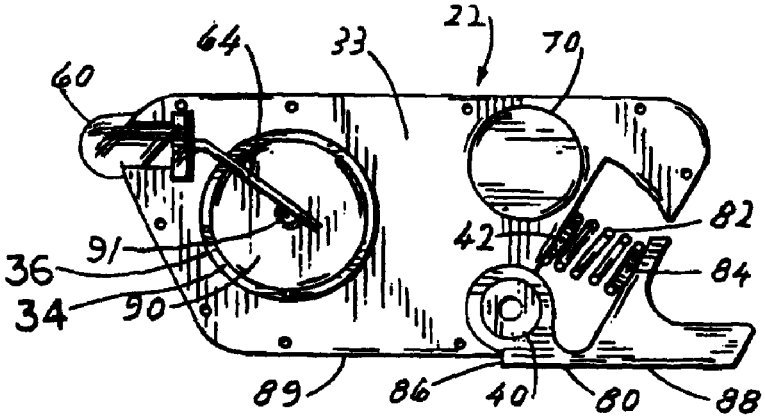
Figure 10:
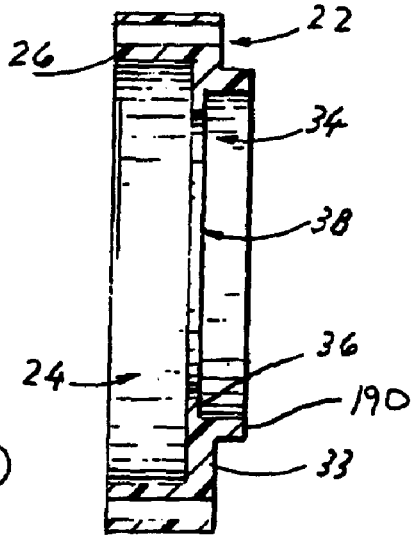

FIG. 18 is a partial cross-sectional view of the flashlight 10 taken along the line 2—2 of FIG. 2. As shown in FIG. 18, switch button 18 is secured to second side cover 170, which is positioned between the second housing side 140 of power source frame housing 14 and the power source frame 22. The engaging element 184 of switch button 18 is preferably positioned adjacent to, but out of contact with, dome plate 92. An outer periphery 186 of the interior surface of switch button 18 engages an outer periphery of dome plate 92. As a force is exerted on switch button 18, the engaging element 184 contacts dome plate 92. The dome plate 92 then moves in a direction towards the power source 50 until it comes in contact with power source 50. Once contact is made, a circuit including the leads of the light source 60, the dome plate 92, and the power source 50 is completed.

Typically, a flashlight pressure switch makes noise upon its engagement. With the switch button configuration shown herein, the noise created by the dome plate 92 coming in contact with the power source 50 is muffled because the switch button 18 completely encloses the dome plate 92 in the power source frame. Moreover, a raised annular portion 190 of the power source frame partially encloses the outer diameter of the switch button to further enclose the switch button and muffle any sound from the operation of the dome plate. In addition, 1.5 millimeter thick 3M tape may be placed over the lead and dome plate to further muffle the sound of the switch operation. In addition, a small notch is placed in the outer periphery 186 of the interior surface of switch button to allow air to escape through the notch when the button is depressed. Thus, any noise created is muffled within the switch button 18. In addition, with the disclosed switch button configuration, when a force is exerted on the dome plate 92, the user is able to feel the flexure of the dome plate as it moves into contact with the power source 50. Thus, the switch button configuration provides tactile feedback to the user so that the user is able to feel when the dome plate has come into contact with the power source, and when it is released. This tactile feedback is particularly useful where the flashlight is being operated out of the direct sight of the user, and it is not possible to tell by sight whether the flashlight is on or off.

While certain features and embodiments of the invention have been described herein, it will be readily understood that the invention encompasses all modifications and enhancements within the scope and spirit of the present invention.

What is claimed is:

1. A flashlight comprising:

a light emitting diode having first and second leads extending therefrom;

a power source having a first side and a second side, the second side being opposite the first side;

a housing enclosing the leads of the light emitting diode and the power source;

a switch disposed adjacent the power source including an electrically conductive switch plate electrically connecting a lead of the light emitting diode and the power source upon activation of the switch, said lead being out of physical contact with said power source when the switch is activated;

wherein the switch is activated by applying pressure to an elastomeric switch element disposed for operative engagement with said switch plate whereby a circuit including the first and second leads of the light emitting diode, the switch plate, and the power source is completed.

2. The flashlight of claim 1 wherein the switch plate is a dome plate.

3. The flashlight of claim 2, wherein the dome plate is positioned between the power source and a lead of the light emitting diode, but out of contact with the power source.

4. A flashlight comprising:

a light emitting diode;

a power source;

a power source frame adapted to receive the power source;

a power source frame housing enclosing at least a portion of the light source, the power source, and the power source frame; and a switch located adjacent the power source and operable to close a circuit including the light source and the power source.

5. The flashlight of claim 4, wherein the power source frame housing further comprises first and second sides, and the power source frame comprises a first side and a second side, the second side of the power source frame being opposite the first side of the power source frame.

6. The flashlight of claim 5, wherein the first and second sides of the power source frame housing each have a plurality of pegs extending therefrom along an inner periphery thereof, and wherein a periphery of the power source frame includes a plurality of pegholes adapted to receive the pegs of the first and second sides of the power source frame housing such that the power source frame housing can be engaged with the power source frame.

7. The flashlight of claim 5, wherein one of the sides of the power source frame housing includes a keyring extension having an opening whereby a keyring can be attached to the keyring extension.

8. The flashlight of claim 7, further comprising a spring-biased keyring lock attached to the power source frame wherein, upon exerting a force against the keyring lock, the keyring extension is opened to permit a keyring to be attached to the keyring extension.

9. The flashlight of claim 8, wherein the spring-biased keyring lock pivots about a circular post positioned on the power source frame.

10. The flashlight of claim 4, further comprising first and second frame side covers having an outer periphery that is sandwiched between the power source frame housing and a periphery of the power source frame.

11. The flashlight of claim 10, wherein the first and second side covers comprise aluminum.

12. The flashlight of claim 10, wherein at least one of the side covers has a flat surface adapted to receive markings or engravings.

13. The flashlight of claim 10, further comprising first and second frame side covers that are composed of a material dissimilar from the frame housing.

14. The flashlight of claim 10, wherein the side covers are flat and lie in parallel planes.

15. The flashlight of claim 10, wherein the switch further includes a button and a dome plate, one of the side covers including the button affixed thereon and positioned adjacent the dome plate.

16. The flashlight of claim 15, wherein the power source frame includes a counterbore having a terminus within the power source frame, and the dome plate is positioned in the counterbore such that an outer periphery of the dome plate is positioned in the counterbore such that an outer periphery of the dome plate abuts the terminus of the counterbore, and wherein the switch is activated by applying pressure to the dome plate.

17. The flashlight of claim 15, wherein the button is made of rubber and muffles the sound of the switch when it is activated.

18. The flashlight of claim 15, wherein the button includes an engaging element for engaging the dome plate.

19. The flashlight of claim 15, wherein the dome plate includes an engaging element for engaging the power source.

20. The flashlight of claim 18, wherein the light emitting diode is of high luminous intensity and emits blue light.

21. The flashlight of claim 4, wherein the power source frame has a thickness in the range of 0.15 and 0.25 inches.

22. The flashlight of claim 21, wherein the thickness is 0.18 inches.

23. The flashlight of claim 21, wherein the thickness of the power source frame is equal to the thickness of the light emitting diode.

24. A flashlight comprising:

a light source;

a power source;

a power source frame enclosing at least a portion of the light source and the power source;

a power source frame housing containing the power source frame, light source and power source;

a switch located adjacent the power source and operable to close a circuit including the light source and the power source; and a keyring extension extending from the power source frame housing having an opening whereby a keyring can be attached to the keyring extension and the keyring extension further includes a spring-biased keyring lock operatively connected to the power source frame wherein, upon exerting a force against the keyring lock, the keyring lock is opened to permit a keyring to be attached to the keyring extension.

25. The flashlight of claim 21, wherein the spring-biased keyring lock pivots about a circular post positioned on the power source frame.

26. The flashlight of claim 24, wherein the keyring lock exerts a force against the outermost edge of the keyring extension.

* * * * *

UNITED STATES PATENT AND TRADEMARK OFFICE

CERTIFICATE OF CORRECTION

PATENT NO. : 6,190,018 B1
DATED : February 20, 2001
INVENTOR(S) : Kevin L. Parsons et al.

It is certified that error appears in the above-identified patent and that said Letters Patent is hereby corrected as shown below:

Column 14,
Line 32, “claim 21” should read -- claim 24 --.

Signed and Sealed this

Twenty-seventh Day of April, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,190,018 C1
DATED : September 9, 2003
INVENTOR(S) : Parsons et al.

It is certified that error appears in the above-identified patent and that said Letters Patent is hereby corrected as shown below:

Title page,
Item [56], References Cited, U.S. PATENT DOCUMENTS,
"Moshch" should read -- Mosch --.
"3,356,428 A 12/1967 Schwartz ... 240/10.65" should be deleted.
"3/1949" should read -- 7/1945 --.
"Hallfrimsson" should read -- Hallgrimsson --.
FOREIGN PATENT DOCUMENTS, "2220753" should read -- 2220735 --.
"GB 2314150 12/1997" should be deleted.
OTHER PUBLICATIONS, add the following:
-- Photon Micro Light and LRI Company Profile
Chicago Miniature Lamp, Inc. Catalog Pages
Snaptron, Inc. Catalog Pages --.

Drawings,
Delete FIG. 2 and substitute attached Replacement Sheet for FIG. 2.
Delete FIG. 9 and substitute attached Replacement Sheet for FIG. 9.

Column 1,
Line 42, the sentence should end with -- . --.

Column 6,
Line 8, "plane 1—1" should read -- plane 10—10 --.
Line 23, "plane 2—2" should read -- plane 18—18 --.

Column 7,
Line 62, the language "power frame housing 14" should read -- power source frame 22 --.

Column 8,
Line 6, the language "frame housing" should read -- frame 22 --.
Line 35, the language "plate 92" should read -- plate 92 (FIG. 18) --.

Column 9,
Line 35, the language "line 1—1" should read -- line 10—10 --.
Line 57, the language "100 located" should read -- 100 (FIG. 3) located --.

UNITED STATES PATENT AND TRADEMARK OFFICE

CERTIFICATE OF CORRECTION

PATENT NO. : 6,190,018 C1
DATED : September 9, 2003
INVENTOR(S) : Parsons et al.

It is certified that error appears in the above-identified patent and that said Letters Patent is hereby corrected as shown below:

Column 11,
Line 36, the language "line 2—2" should read -- line 18—18 --.

Signed and Sealed this

Eighth Day of November, 2005

JON W. DUDAS
*Director of the United States Patent and Trademark Office*

US006190018C1

(12) EX PARTE REEXAMINATION CERTIFICATE (4846th)

United States Patent

Parsons et al.

(10) Number: US 6,190,018 C1

(45) Certificate Issued: Sep. 9, 2003

(54) MINIATURE LED FLASHLIGHT

(75) Inventors: Kevin L. Parsons, Appleton, WI (US); Donald A. Keller, Irving, TX (US); W. Clay Reeves, Dallas, TX (US)

(73) Assignee: Armament Systems and Procedures, Appleton, WI (US)

Reexamination Request:

No. 90/005,975, Apr. 5, 2001
No. 90/006,160, Dec. 19, 2001
No. 90/006,445, Nov. 7, 2002
No. 90/006,573, Mar. 24, 2003

Reexamination Certificate for:

Patent No.: 6,190,018
Issued: Feb. 20, 2001
Appl. No.: 09/226,322
Filed: Jan. 6, 1999

(51) Int. Cl.[7] ..... F21V 33/00

(52) U.S. Cl. ..... 362/116; 362/200; 362/800

(58) Field of Search ..... 362/116, 196, 362/200, 800, 205

(56) References Cited

U.S. PATENT DOCUMENTS

| | | | |
|---|---|---|---|
| 762,720 | A | 6/1904 | Hubert |
| 1,047,525 | A | 12/1912 | Hubert |
| 1,315,457 | A | 9/1919 | Benedict |
| 1,436,340 | A | 11/1922 | Gallagher |
| 1,866,600 | A | 7/1932 | Rauch |
| 2,249,692 | A | 7/1941 | Gelardin |
| 2,412,056 | A | 12/1946 | Moshch |
| 2,714,152 | A | 7/1955 | Ackerman et al. |
| 2,762,907 | A | 9/1956 | Schwartz |

(List continued on next page.)

FOREIGN PATENT DOCUMENTS

| | | | |
|---|---|---|---|
| GB | 1058466 | 2/1967 | |
| GB | 2220753 A | 1/1990 | |
| GB | 2314150 | 12/1997 | |
| GB | 2 314 150 A | 12/1997 | ..... F21L/7/00 |
| JP | 29701 | of 1995 | |
| JP | 19950102 A | 2/1998 | |

OTHER PUBLICATIONS

Photographs of Lumatec TinyMite Flashlight.

Lumatec 1997 Holiday Collection Catalog.

Lumatec fall 1997 New Products Brochure.

International Electrical Commissioner (IEC) Miniature Lamps Standards 60983.

ANSI C79.1–1994 American Standard of Nomenclature for Glass Bulbs Intended for Use with Electric Lamps.

"Hiyoshi Frosted–LED Lamp" brochure bearing Bates Nos. LL 001609–LL 001624.

Photocopies of miniature flashlight (source unknown) bearing Bates Nos. LL 001646–LL 001648.

"Hiyoshi 'Frosted' LED Globes, Decorative Lamp with five built–in LEDs", two pages bearing Bates Nos. LL 001770–LL 001771.

REI Catalog "Get Outside Yourself", cover page and pp. 6–8 (date unknown) bearing Bates Nos. LL 001788–LL 001791.

Lifestyle Catalog (Late Summer 2001), two pages bearing Bates Nos. LL 001792–LL 001793.

Seventh Avenue Catalog (date unknown) two pages bearing Bates Nos. LL 001794–LL 001795.

Taylor Gifts Catalog (date unknown) cover page and p. 14 bearing Bates Nos. LL 001796–LL 001797.

International AutoSport Catalog ("Holidays 2001") cover page and p. 27 bearing Bates Nos. LL 001798–LL 001799.

Lizell Catalog (Christmas 2001) two pages bearing Bates Nos. LL 001800–LL 001801.

*Primary Examiner*—Stephen F. Husar

(57) ABSTRACT

A flashlight having a power source and a light source having a high intensity positioned in a power source frame. The flashlight further includes a power source frame housing that encloses the power source frame. The frame and the housing cooperate to secure and protect the internal components of the flashlight. The flashlight is further provided with side covers that have flat surfaces to receive markings or engravings. A switch is provided to activate the light source, the switch preferably providing tactile feedback to the user.

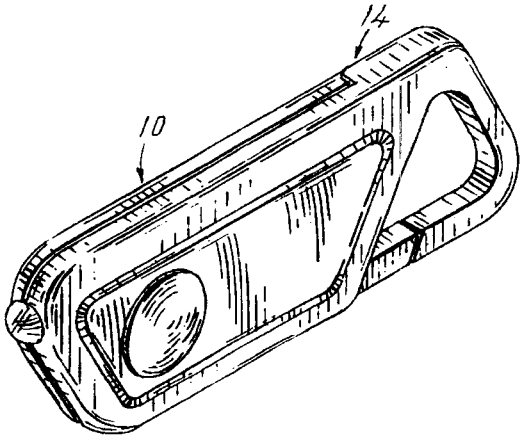

U.S. PATENT DOCUMENTS

| | | | | |
|---|---|---|---|---|
| 3,057,992 | A | | 10/1962 | Baker |
| 3,085,149 | A | | 4/1963 | Giwosky |
| 3,085,150 | A | | 4/1963 | Bautsch |
| 3,119,564 | A | | 1/1964 | Zalman |
| 3,256,428 | A | | 6/1966 | Schwartz ..... 240/10.65 |
| 3,310,668 | A | | 3/1967 | Schwartz ..... 240/6.4 |
| 3,330,949 | A | | 7/1967 | Bush ..... 240/6.45 |
| 3,345,508 | A | | 10/1967 | Chung |
| 3,356,428 | A | | 12/1967 | Schwartz ..... 240/10.65 |
| 3,359,411 | A | | 12/1967 | Schwartz ..... 240/6.4 |
| 3,589,155 | A | | 6/1971 | Kamp |
| 3,613,414 | A | | 10/1971 | Ostrager |
| 3,732,414 | A | | 5/1973 | Franc |
| 3,804,307 | A | | 4/1974 | Johnston |
| 3,860,847 | A | | 1/1975 | Carley ..... 313/110 |
| 3,866,035 | A | | 2/1975 | Richey, Jr. |
| 3,870,843 | A | | 3/1975 | Witte |
| 3,913,362 | A | | 10/1975 | Goessling et al. |
| 4,076,976 | A | | 2/1978 | Fenton |
| 4,085,315 | A | | 4/1978 | Wolter et al. |
| 4,101,955 | A | | 7/1978 | DuNah |
| 4,122,510 | A | | 10/1978 | Halliday, Jr. |
| 4,129,899 | A | | 12/1978 | Dunbar |
| 4,164,132 | A | | 8/1979 | Loman |
| 4,210,953 | A | | 7/1980 | Stone |
| 4,228,484 | A | | 10/1980 | Johnstone |
| 4,242,724 | A | | 12/1980 | Stone |
| 4,261,026 | A | | 4/1981 | Bolha |
| 4,276,582 | A | | 6/1981 | Burnett |
| 4,303,966 | A | | 12/1981 | Wolter |
| 4,336,574 | A | | 6/1982 | Goodman |
| 4,346,329 | A | | 8/1982 | Schmidt |
| 4,392,186 | A | | 7/1983 | Cziment |
| 4,398,237 | A | | 8/1983 | Doyel |
| 4,399,495 | A | | 8/1983 | Leopoldi et al. |
| 4,408,261 | A | | 10/1983 | Polakoff |
| 4,409,645 | A | | 10/1983 | Sloan |
| 4,422,131 | A | | 12/1983 | Clanton et al. |
| 4,433,365 | A | | 2/1984 | Rousseau |
| 4,517,627 | A | | 5/1985 | Bradford |
| 4,521,833 | A | | 6/1985 | Wolter |
| D285,989 | S | | 10/1986 | MacDonald |
| D290,518 | S | | 6/1987 | Rakocy et al. |
| 4,731,712 | A | | 3/1988 | Amthor |
| 4,768,138 | A | | 8/1988 | Leopoldi et al. |
| 4,893,222 | A | | 1/1990 | Mintzer |
| D311,067 | S | | 10/1990 | Chabria |
| 5,029,055 | A | | 7/1991 | Lindh |
| 5,043,854 | A | | 8/1991 | Gammache |
| 5,158,356 | A | * | 10/1992 | Guthrie ..... 362/200 |
| 5,181,927 | A | | 1/1993 | Song |
| D337,200 | S | | 7/1993 | Keller |
| 5,285,586 | A | | 2/1994 | Goldston et al. |
| 5,386,351 | A | | 1/1995 | Tabor ..... 362/201 |
| 5,457,613 | A | | 10/1995 | Vandenbelt et al. |
| 5,463,539 | A | | 10/1995 | Vandenbelt et al. |
| 5,465,197 | A | | 11/1995 | Chien |
| 5,475,368 | A | | 12/1995 | Collins |
| 5,541,817 | A | | 7/1996 | Hung ..... 362/116 |
| D372,356 | S | | 8/1996 | Marguerite |
| 5,617,751 | A | | 4/1997 | Song |
| D381,803 | S | | 8/1997 | Crego ..... D3/208 |
| D394,345 | S | | 5/1998 | Marguerie |
| D400,326 | S | | 10/1998 | Fisher ..... D32/42 |
| D401,371 | S | | 11/1998 | Chen |
| D402,069 | S | | 12/1998 | Chan |
| 5,893,631 | A | | 4/1999 | Padden |
| 5,894,196 | A | | 4/1999 | McDermott ..... 313/512 |
| 5,956,985 | A | | 9/1999 | Chang ..... 70/456 R |
| 6,109,762 | A | | 8/2000 | Hallgrimsson et al. ..... 362/200 |
| 6,164,795 | A | | 12/2000 | Lopez ..... 362/116 |

* cited by examiner-

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–3, 24 and 26 is confirmed.

Claims 4, 6, 8 and 10 are determined to be patentable as amended.

Claims 5, 7, 9, 11–23 and 25, dependent on an amended claim, are determined to be patentable.

4. A flashlight comprising:

a light emitting diode *light source*;

a power source;

a power source frame adapted to receive the power source;

a power source frame housing enclosing at least a portion of the light source, the power source, and the power source frame; [and]

*the power source frame housing being elongated and the light source being located at one end thereof; and* a switch [located adjacent] *next to* the power source and operable to close a circuit including the light source and the power source.

6. [The flashlight of claim 5,] *A flashlight comprising:*

*a light emitting diode light source;*

*a power source;*

*a power source frame adapted to receive the power source;*

*a power source frame housing enclosing at least a portion of the light source, the power source, and the power source frame;*

*a switch located adjacent the power source and operable to close a circuit including the light source and the power source;*

*wherein the power source frame housing further comprises first and second sides, and the power source frame comprises a first side and a second side, the second side of the power source frame being opposite the first side of the power source frame; and* wherein the first and second sides of the power source frame housing each have a plurality of pegs extending therefrom along an inner periphery thereof, and wherein a periphery of the power source frame includes a plurality of pegholes adapted to receive the pegs of the first and second sides of the power source frame housing such that the power source frame housing can be engaged with the power source frame.

8. [The flashlight of claim 7,] *A flashlight comprising:*

*a light emitting diode light source;*

*a power source;*

*a power source frame adapted to receive the power source;*

*a power source frame housing enclosing at least a portion of the light source, the power source, and the power source frame;*

*a switch located adjacent the power source and operable to close a circuit including the light source and the power source;*

*wherein the power source frame housing further comprises first and second sides, and the power source frame comprises a first side and a second side, the second side of the power source frame being opposite the first side of the power source frame;*

*wherein one of the sides of the power source frame housing includes a keyring extension having an opening whereby a keyring can be attached to the keyring extension; and* further comprising a spring-biased keyring lock attached to the power source frame wherein, upon exerting a force against the keyring lock, the keyring extension is opened to permit a keyring to be attached to the keyring extension.

10. [The flashlight of claim 4,] *A flashlight comprising:*

*a light emitting diode light source;*

*a power source;*

*a power source frame adapted to receive the power source;*

*a power source frame housing enclosing at least a portion of the light source, the power source, and the power source frame;*

*a switch located adjacent the power source and operable to close a circuit including the light source and the power source; and* further comprising first and second frame side covers having an outer periphery that is sandwiched between the power source frame housing and a periphery of the power source frame.

* * * * *